United States Patent [19]

Bloomquist

[11] 4,454,995

[45] Jun. 19, 1984

[54] CUTTER HEAD FOR A MATERIAL CUTTING MACHINE

[75] Inventor: Gerald E. Bloomquist, Wausau, Wis.

[73] Assignee: Patricia Bloomquist, Wausau, Wis.

[21] Appl. No.: 362,555

[22] Filed: Mar. 26, 1982

Related U.S. Application Data

[63] Continuation of Ser. No. 132,901, Mar. 24, 1980, abandoned.

[51] Int. Cl.[3] ..... B02C 18/18

[52] U.S. Cl. ..... 241/277; 144/174; 144/230; 241/294

[58] Field of Search ..... 144/172, 174, 230; 241/294, 277, 280–282; 83/356.3

[56] References Cited

U.S. PATENT DOCUMENTS

| | | | |
|---|---|---|---|
| 2,825,371 | 3/1952 | Forman | 241/294 UX |
| 2,830,770 | 4/1958 | De Luca | 241/294 X |
| 2,986,347 | 5/1961 | Stevenson | 241/294 X |
| 3,378,210 | 4/1968 | Bambach | 241/294 X |
| 3,679,246 | 7/1972 | Bloomquist et al. | 241/294 X |
| 3,838,724 | 10/1974 | Buchacher et al. | 83/356.3 |
| 3,865,164 | 2/1975 | Sybertz | 144/172 X |
| 3,882,912 | 5/1975 | Sybertz | 144/230 X |

FOREIGN PATENT DOCUMENTS

| | | | |
|---|---|---|---|
| 163710 | 6/1958 | Sweden | 241/294 |

*Primary Examiner*—Howard N. Goldberg
*Attorney, Agent, or Firm*—Rudolph L. Lowell

[57] ABSTRACT

The cutter head is adapted to cut material such as wood, frozen meat, vegetables and the like into pieces of predetermined length, width and thickness. The cutter head has a rotor body of a cylindrical shape formed with at least one axially extended piece-receiving cavity that has a leading side; and a knife unit that includes a mounting section with a knife section projected outwardly from a flat side of the mounting section. The knife section has a flat leading side and a flat trailing side which intersect at an acute angle to form a cutting edge. The knife unit is supported in the rotor body with the flat side of the mounting section in a plane parallel to a plane extended diametrically of the rotor body and through the cutting edge when the leading side of the knife section is arranged opposite the leading side of the piece-receiving cavity. The thickness of the cut piece is determined by the location of the cutting edge outwardly from the peripheral surface of the rotor body; the width thereof by the axial extent of the cutting edge; and the length thereof by the distance between the diametrically extended plane and the plane of the flat side of the knife mounting section.

3 Claims, 8 Drawing Figures

CUTTER HEAD FOR A MATERIAL CUTTING MACHINE

This is a continuation, of application Ser. No. 132,901, filed Mar. 24, 1980, now abandoned.

BACKGROUND OF THE INVENTION

Rotary cutter heads for machines to cut meats and vegetables into strips or cubes are disclosed in U.S. Pat. Nos. 3,195,594 and 3,297,068. A cutter head for pulverizing frozen material is disclosed in U.S. Pat. No. 3,037,540.

In the U.S. Pat. No. 3,195,594 patent, an axial cavity in the cylindrical rotor body has a set of transversely extended knives arranged in an axially spaced relation at the leading edge thereof and an axially extended knife located at its trailing edge. By initially passing the material such as potatoes or cheese through a wire cutter, the knife arrangement will cut the material into cubes.

In U.S. Pat. No. 3,297,068, a strip cutting knife means of a unit construction has a series of transverse leading knives spaced longitudinally of a trailing axial knife, with the unit being mounted on a cylindrical rotor body at the trailing edge of an axially extended cavity. The single knife unit thus functions alone to cut material into strips.

None of the machines disclosed in these patents are capable of cutting wood or like material into substantially flat pieces of a predetermined length, thickness and width concurrently with breaking the pieces into shorter lengths having a porosity or density different than the material being cut.

SUMMARY OF THE INVENTION

The cutting machine is capable of efficient operation over a long service life to reduce wood and like material into uniformly cut pieces of substantially like size concurrently with preparing the material for use as compost or bedding. By merely changing cutters, the material can be cut into substantially flat pieces, or into pieces of a predetermined length, width and thickness. Variations in the dimensions of the cut pieces may be varied over a relatively wide range by merely varying the size of the cutter head to accomodate a particular cutting job. The cutters in the cutter head are of a one piece construction for easy and rigid assembly with an associated cylindrical rotor body and for easy removal for maintanance or replacement purposes.

DESCRIPTION OF THE INVENTION

Figure 1:
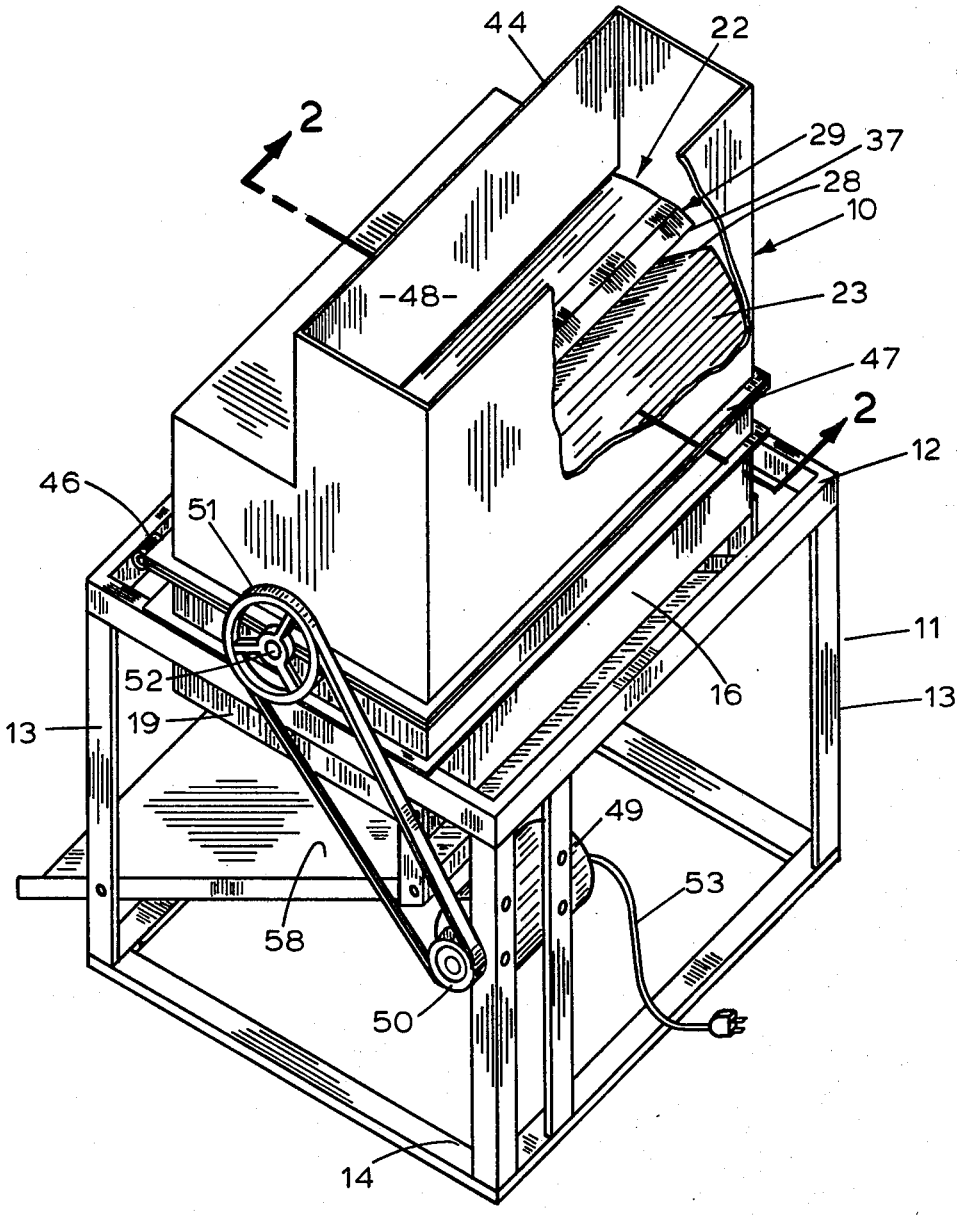
FIG. 1 is a perspective view of a cutting machine of this invention with parts broken away to more clearly show its construction.

Referring to the drawings, the cutting machine of this invention, indicated generally as 10 in FIG. 1, is shown as being mounted on a frame unit 11 that has an open top frame structure 12 of a generally rectangular shape and supported on legs 13 secured to a base 14. The machine 10 includes a housing or casing 16 (FIGS. 1 and 2) of an open rectangular shape having side walls 17 and 18 and end walls 19. Positioned within and extended longitudinally of the housing 16 is a cutter head 22 of this invention.

The cutter head 22 (FIG. 2) is comprised of a cylindrical body or rotor member 23 mounted on a shaft 24 which projects outwardly from opposite ends of the body member 23. The peripheral surface 26 of the cylindrical body member 23 is formed with a longitudinally extended piece-receiving recess or groove 27 (FIG. 2) having a leading side wall 28. The trailing end of the groove 27 is open to a transversely extended socket 31 coextensive in length with the groove 27, and of a size and shape for receiving a cutting unit 29. The cutting unit 29 is integrally formed with a mounting section 32 receivable within the socket 31 and having a flat side 30. Projected laterally from one end of the flat side 30 is a knife section 33 with a leading side 34 and a trailing side 36 that intersects at an acute angle to form a continuous cutting edge 37.

Figure 2:
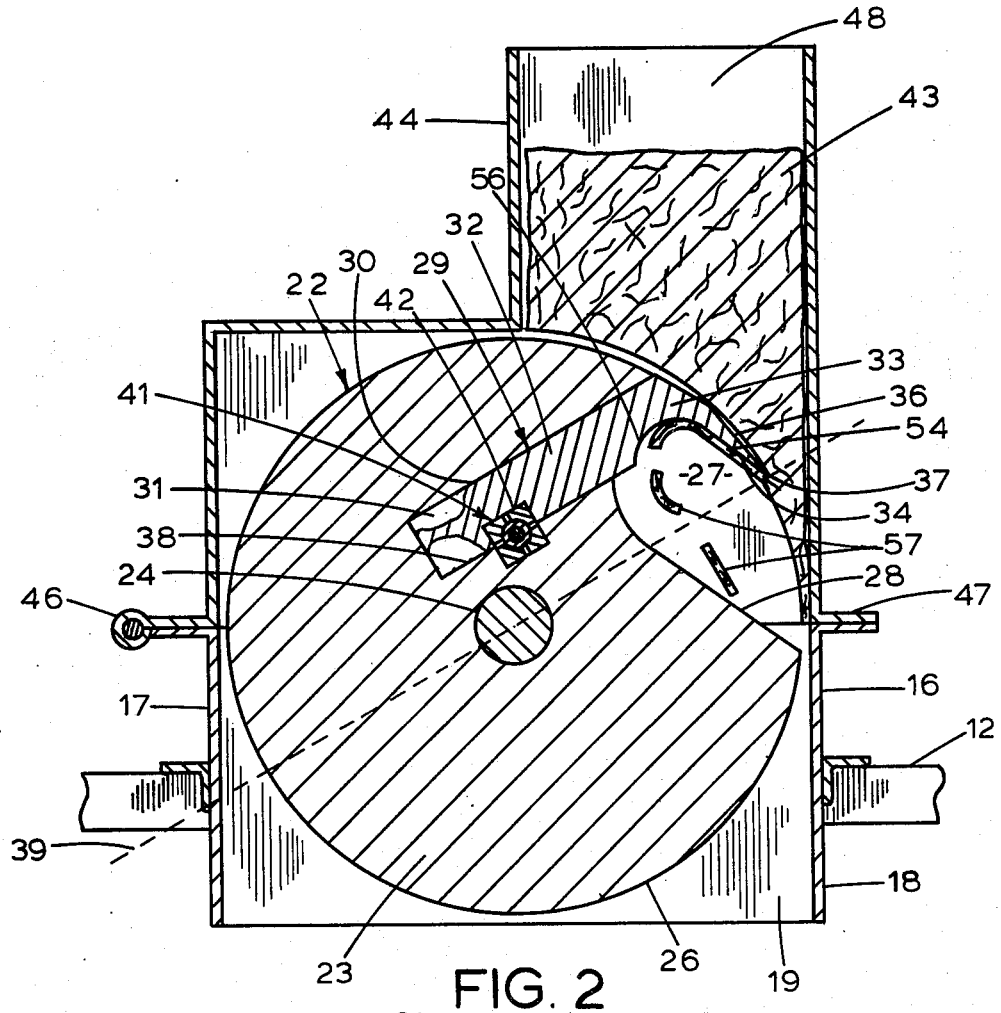
FIG. 2 is an enlarged sectional view taken substantially along the line 2—2 in FIG. 1 showing the assembly relation of the cutter head and material hopper and the action of the cutter head on the material in the hopper.

The socket 31 has a flat side wall 38 which is adjacent the flat side 30 of the mounting section 32 and arranged in a plane parallel to a plane, indicated at 39 in FIG. 2, that extends diametrically of the cylindrical body member 23. The distance between the plane of the socket side 38, and in turn of the flat side 30 of the mounting section 32, from the plane 39 is such that when the mounting section is disposed within the socket 31, the diametrical plane 39 of the body member 23 extends through the cutting edge 37 when the knife section leading side 34 is disposed opposite the leading side or surface 28 of the groove 27. The distance between the mounting section flat side 30 and the diametrically extended plane 39 is thus substantially equal to the length of the knive section 33. The cutting unit 29 is rigidly secured within the body member 23 by a key lock assembly 41 that includes an axially extended locking bar 42 insertable within axially extended mating grooves 40 and 45 formed in the mounting section 32 and cylindrical body member 23, respectively. For a detailed description of key lock assembly 41, reference is made to U.S. Pat. No. 3,679,246, and such description is to be incorporated herein. In the assembly of the cutting unit 29 within the body member 23, the mounting section 32 and its associated socket 31 are of a relative size and shape such that when the cutting unit is secured to the body member by the key lock 41, the cutting edge 37 is spaced outwardly from the peripheral surface 26 of the body member 23 a distance equal to the thickness of the pieces to be cut by the machine 10. It is to be further noted that the trailing side 36 of the knife section 33 (FIG. 2) is within the confines of the arcuate path defined by the cutting edge 37 on rotation of the cutter head 22. The knife section trailing side 36 is thus in a working clearance with the material 43 being cut so as not to interfere with the thickness dimension of a piece to be cut, as set by the spacing of the cutting edge 37 outwardly from the peripheral surface 26 of the body member 23.

The material 43 to be cut is receivable within a hopper 44 pivoted at 46 (FIG. 2) on the housing 16 for pivotal swinging movement to an open position located to one side of the housing 16 and to a closed position covering the open top of the housing 16 and in resting engagement on the top surface thereof. The hopper assembly 44 may be securely locked in its closed position by the provision of any suitable locking means (not shown) adapted to secure the hopper free end 47 with the housing 16.

The hopper 44 includes a chute 48 of a substantially rectangular shape in transverse cross section for feeding the material 43 into the cutter head 22. The chute 48 is of a size to define an area or cutting zone relative to the cutter head 22 which is coextensive in length with the cutter head and of a width equal substantially to one half of the diameter of the body member 23. With the chute 48 arranged at one side of the hopper 44, the lower end thereof is open to an upper quarter segment of the cutter head so that the cutting action of the cutting unit 29 takes place during movement thereof from the uppermost position of the cutting edge 37 downwardly through the upper quarter segment located below the chute 48.

The cutter head 22 (FIG. 1) is operated by a motor 49 mounted on the frame 11 having a drive pulley 50 in belt connection with a pulley 51 mounted on a projected end 52 of the shaft 24. The motor 49 is of a usual electrical type having a plug-in 53 for connection with a source of electrical supply.

In the operation of the cutter head 22, the body member 23 is rotated in a direction such that the upper quarter segment thereof immediately below the chute 48 moves downwardly in an arc across the lower end of the chute 48, as shown in FIG. 2. The material 43 within the upright chute 48 may be fed by gravity or other means into engagement with the knife section 33 of the cutting unit 29 in a manner to assure uniformity of the cutting action. In this cutting action, the material 43 is initially cut into pieces 54 (FIG. 2) of a length substantially equal to the length of the knife cutting section 33. As illustrated, the leading side 34 of the knife section 33 terminates in an upwardly curved recess 56 formed in the flat side 30 of the mounting section 32 and extended axially of the cutting unit 29 over the full length thereof.

A cut piece 54 on entering the recess 56 is bent or curved inwardly of the body member 23 and subjected to a breaking stress which breaks up the initially cut piece 54 into shorter length pieces 57 of substantially equal length. These pieces 57 are received within the axially extended groove 27 for discharge therefrom during the travel of the groove over the lower portion of the cutter head 22. The pieces 57 are dropped onto a receiving pan 58 (FIG. 1) for delivery onto a conveyor or the like (not shown). As shown in FIG. 2, the shorter length pieces 57 tend to assume the original flat shape of the initially cut piece 54.

Figure 3:
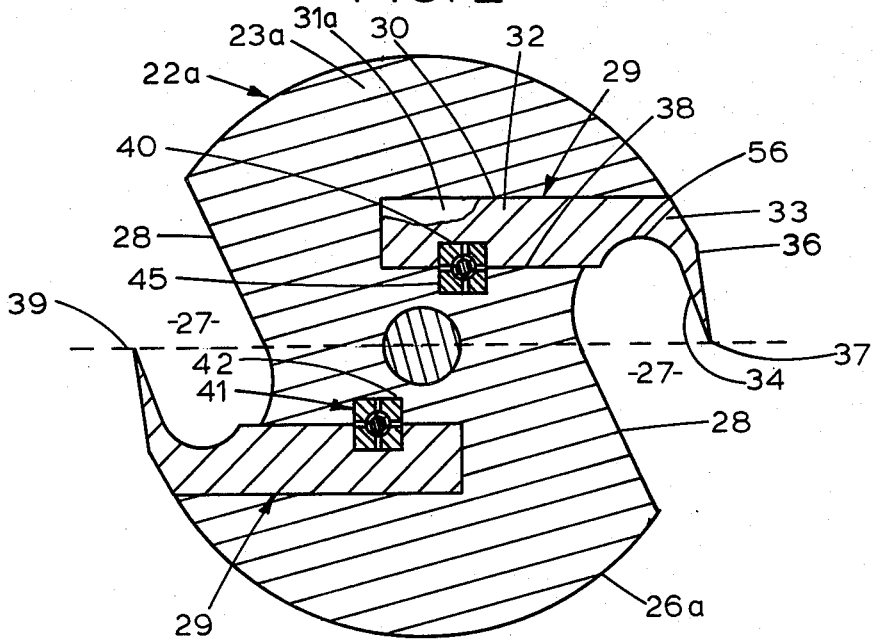
FIG. 3 is a sectional view of a modified cutter head that utilizes a pair of the knife assemblies shown in FIG. 1, arranged diametrically opposite each other.

The cutting rate of the cutter head 22 may be increased by the utilization of a pair of cutting units 29 arranged at diametrically opposite sides of the body member as illustrated for the cylindrical body member **23*a* in FIG. 3 wherein similar numerals will be used to indicate like parts in FIG. 2. The knife receiving sockets 31*a* (FIG. 3) are arranged in a parallel spaced relation to opposite sides of an equidistant from the diametrically extended plane 39 so that the plane 39 extends through each of the cutting edges 37. With the cutting edges 37 spaced like distances outwardly from the peripheral surface 26*a* of the body member 23*a*, each of the cutting units 29 functions to produce similar cut pieces from the material 43. The cutter head 22*a* is thus capable of doubling the cutting action of the cutter head 22 of FIG. 2**.

Figure 4:
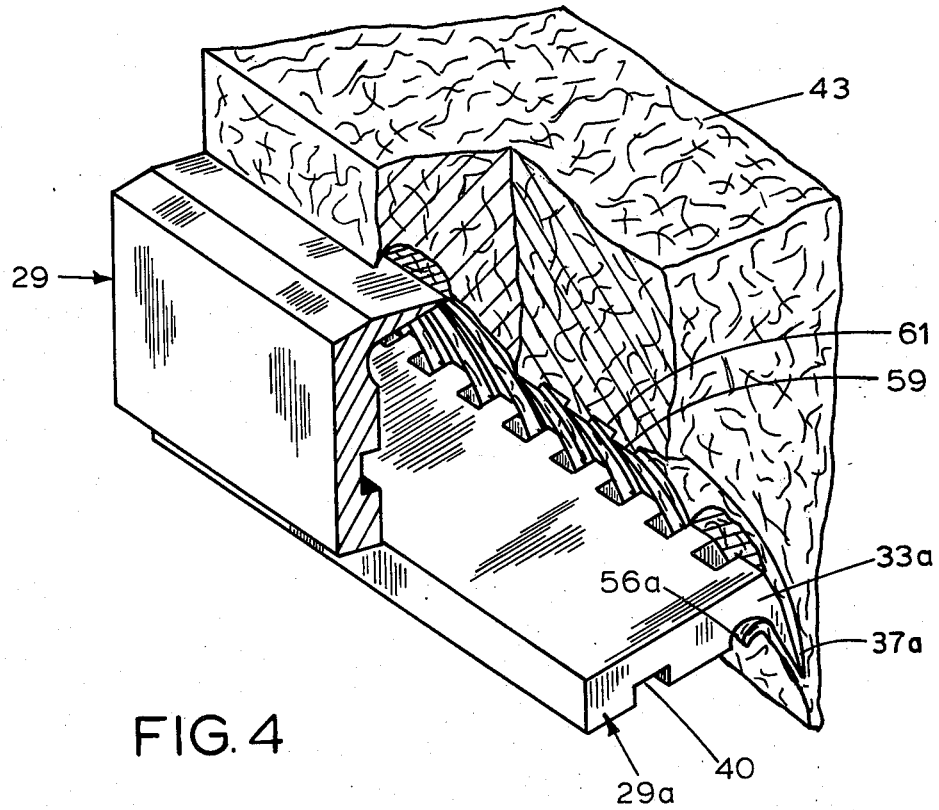
FIG. 4 is a diagrammatic perspective view showing the complementary cutting action of a pair of knives in the cutter head of FIG. 3, wherein one of such knives has a serrated cutting edge and the other knife a continuous cutting edge.

The body member **23*a* may be used to cut the material 43 into strips by substituting for one of the cutting units 29 a cutting unit 29*a*, as shown diagrammatically in FIG. 4, which is similar in all respects to a cutting unit 29 except that the cutting edge 37*a* and a portion of the knife section 33*a* are serrated or notched. The cutting unit 29*a* is assembled in the cutter head 23*a* in all respects the same as the cutting unit 29** which is being replaced.

In the operation of the cutter head of FIG. 4 as the cutting unit **29*a* is moved downwardly into the material 43, there is formed alternate projections 59 and notches 61. The following cutting unit 29 having a knife section 33 with a continuous cutting edge 37 acts only upon the projections 59. It is seen, therefore, that the material removed by the cutting knife 29*a*, to form the notches 61 in the material 43, is of substantially the same size and shape as that of the remaining projections 59 that are removed by the cutting knife 29. Thus, after the initial cut by the serrated cutting unit 29*a*, both of the cutting units 29 and 29*a* function to remove like amounts and kind of the material 43 whereby the cut piece are of the same uniformity. The strips initially cut by either the cutting knife 29 or 29*a* a are broken up into pieces of shorter length on entering the recesses 56 and 56*a*, respectively, in the same manner as previously described in connection with the cutting knife 29 in FIG. 2**.

Figure 5:
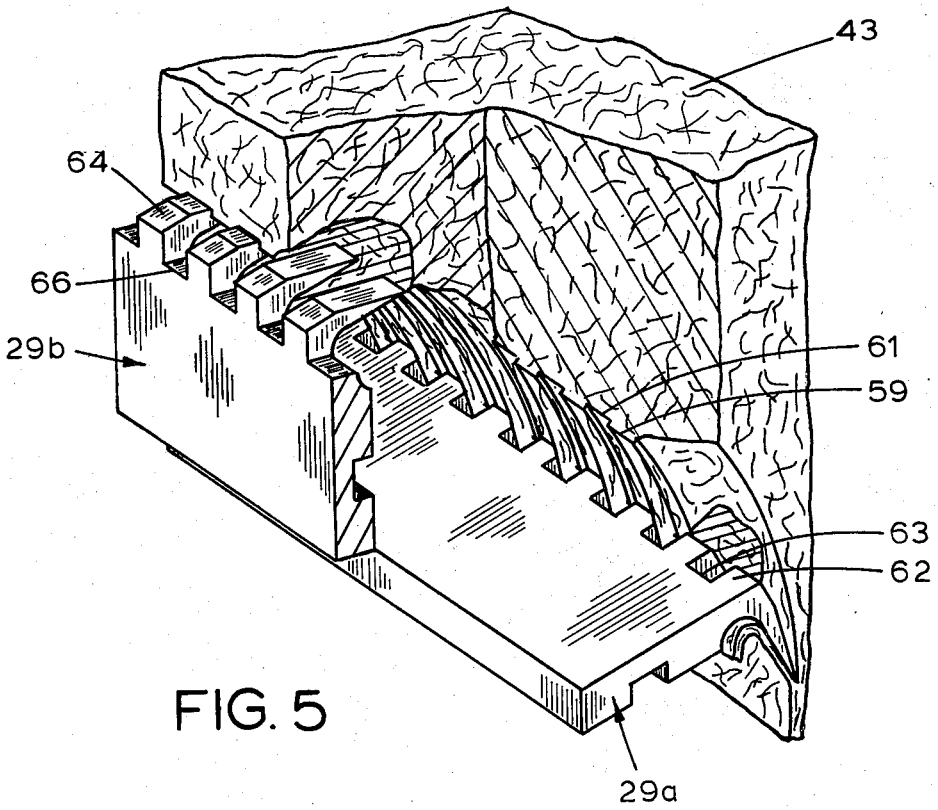
FIG. 5 illustrated similarly to FIG. 4 and shows the complementary cutting action of a pair of knives in the cutter head of FIG. 3 wherein each of the knives has a serrated or notched cutting edge.

In FIG. 5, there is illustrated a pair of cutting units **29*a* and 29*b* that can be used with the cylindrical body member 23*a*. The cutting unit 29*b* is similar in all respects to the cutting unit 29*a* except for the alternate projections and notches 64 and 66 being axially offset relative to the projections 62 and notches 63 of the cutting unit 29*a*. Thus, assuming the cutting unit 29*a* to be in a leading relation relative to the cutting unit 29*b*, the material 43 will be cut so as to leave the projections 59 and notches 61. The following knife unit 29*b* will then operate to remove the projections 59. If the cutting unit 29*b* is in a leading relation relative to the cutting unit 29*a*, the projections 59 and notches 61 formed in the cutting material 43 will be off set from their positions shown in FIG. 5 to positions corresponding to the projections 64 and 66 on the cutting unit 29*b***.

Figure 6:
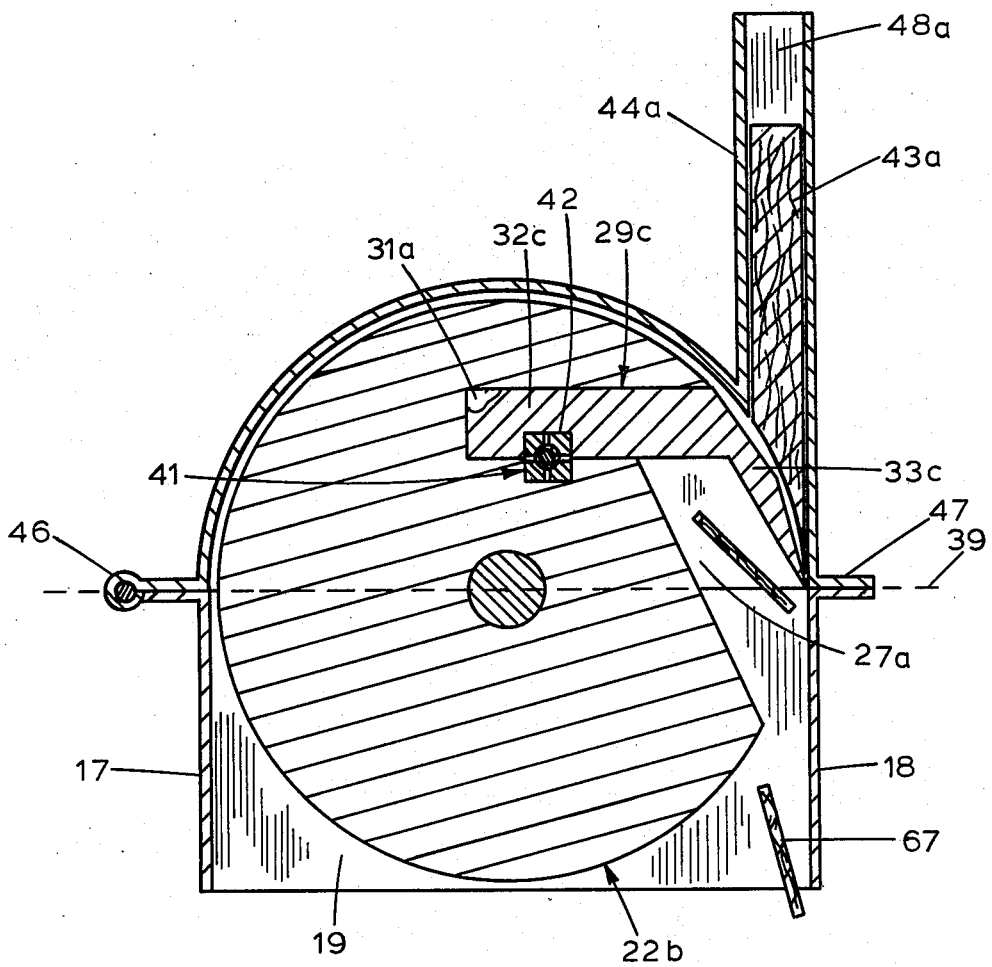
FIG. 6 is a sectional view illustrated similarly to FIG. 2 showing a modified form of material hopper and cutter head adapted to cut flat pieces from a material having a thickness less than the length of the cutting knife.

In the modified form of the invention shown in FIG. 6, the cutter head **23*b* has an axially extended cavity or recess 27*a* and socket 31*a* operatively associated with the cutting unit 29*c* in all respects the same as previously described for the cutting unit 29 in the cutter head 23. Also, the cutting unit 29*c* is the same as the cutting unit 29 in the cutter head 23 except for the elimination of a piece-breaking recess corresponding to the recess 56 of the cutting unit 29. The cutting unit 29*c*, therefore, is without any provision for breaking a piece initially cut into pieces of shorter length. The pieces 67 cut from the material 43***a*, therefore, are flat and of a length substantially equal to the length of the knife section 33*c*.

To provide for a cutting of the flat pieces 67, the hopper 44*a* (FIG. 6) is formed with a chute 48*a* of a narrow rectangular shape in cross section wherein the width or dimension of the chute 48*a* transversely of the cutter head 22*b* is less than the length of the cutting section 33*c* of the cutting unit 29*c*. As a result, the piece 67 is cut from the material 43*a* and received in the recess 27*a* without any contact of the cut piece with the mounting section 32*c* of the cutting unit 29*c*. The piece 67, therefore, as initially cut, is received in the cavity 27*a* for delivery to the receiving pan 58 of the machine 10.

In the cutting of a wood material for animal bedding or compost, it is desirable that the bedding pieces have substantial uniformity and capable of being handled without excessive disintegration or falling apart. However, in the use of the wood chips or pieces for compost purposes, the pieces should be of a loose fibrous texture and readily disintegrated for mixing with soil.

Figure 7:
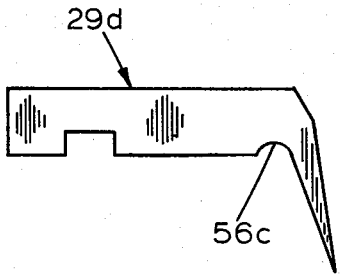
FIGS. 7 and 8 show modified forms of cutting knives that can be used in the cutter head of FIG. 2.

For animal bedding purposes, use may be made of the cutting unit 29 or if pieces of shorter length than the broken pieces 57 are wanted, the modified knife 29*d* of FIG. 7 may be used. In the knife unit 29*d*, the curved recess 56*c* is of a reduced size relative to the recess 56.

It is seen, therefore, that the reduced recess 56*c* provides for an earlier breaking of the initially cut piece so as to produce broken pieces of a shorter length than those produced by the cutting unit 29.

Figure 8:
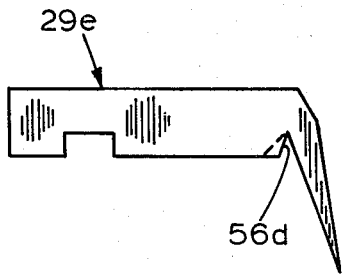

For preparing wood into a compost material, the cutting unit 29*e* of FIG. 8 may be used wherein the recess 56*d* is of a V-shape in transverse cross section so that the initially cut piece moves into the recess 56*d* with an impacting force against the side wall of the recess 56*d*. The resultant impact break tends to both fluff and separate the wood fibers for maximum exposure for disintegration and soil mixing purposes. If larger impact broken pieces are wanted it is only necessary to enlarge the recess 56*d* as indicated by dotted lines in FIG. 8.

Although the invention has been described with respect to preferred embodiments thereof, it is to be understood that it is not to be so limited since changes and modifications can be made therein which are within the full intended scope of this invention as defined by the appended claims.

I claim:

1. A cutter head for a machine for cutting a material into pieces comprising:

(a) a cylindrical body member adapted to be mounted for rotation about the longitudinal axis thereof, said body member having at least one axially extended piece-receiving cavity in the outer peripheral surface thereof formed with a leading surface, (b) a knife means operatively associated with said cavity having a mounting section with a flat side and an elongated knife section at one end of said mounting section projected outwardly from said flat side, said knife section having a flat leading side and a flat trailing side which intersects the leading side at an acute angle to form a cutting edge, (c) means for securing said knife means to the body member with the leading side of the knife section opposite the leading surface of the cavity and the flat side of the mounting member extended transversely of the body member in a plane substantially parallel to a plane extended diametrically of the body member and through said cutting edge, (d) said cutting edge extended axially of the body member at a position outwardly from the peripheral surface thereof a distance substantially equal to the thickness of a piece to be cut from the material, (e) said trailing side of the knife section and one end of the mounting section located within the confines of the arcuate path defined by the cutting edge of rotation of said body member; whereby the material is cut into pieces, each of which has a length substantially equal to the distance between said two parallel planes and a width no greater than the axial length of the cutting edge, (f) a second axially extended piece-receiving cavity in the outer peripheral surface of the body member positioned diametrically opposite said one cavity and having a leading surface, (g) a second knife means including a mounting section having a flat side and an elongated knife section at one end of said mounting section projected outwardly from said flat side, said knife section having a flat leading side and a flat trailing side which intersects the leading side at an acute angle to form a cutting edge, (h) means for securing said second knife means to the body member with the leading side of the knife section therefor opposite the leading surface of the second cavity, the flat side of the mounting section thereof extended transversely of the body member in a plane substantially parallel to said diametrically extended plane, and the cutting edge thereof positioned in said diametrically extended plane, (i) said cutting edge of the second knife means extended axially of the body member at a position outwardly from the peripheral surface thereof a distance substantially equal to the thickness of the piece to be cut from said material by the first knife means, and (j) said trailing side of the knife section and the one end of the mounting portion of the second knife means located within the confines of the arcuate path defined by the path of the cutting edge of said second knife means on rotation of said body member, whereby the material is cut into pieces having a length substantially equal to the distance between said diametrically extended plane and the flat side of the mounting portion of the second knife means and a width no greater than the axial length of the cutting edge of said second knife means, (k) with the cutting edge of one of said knife means continuous and the cutting edge of the other of said knife means notched whereby the cut pieces are of a strip form.

2. A cutter head for a machine for cutting a material into pieces comprising: (a) a cylindrical body member adapted to be mounted for rotation about the longitudinal axis thereof, said body member having at least one axially extended piece-receiving cavity in the outer peripheral surface thereof formed with a leading surface, (b) a knife means operatively associated with said cavity having a mounting section with a flat side and an elongated knife section at one end of said mounting section projected outwardly from said flat side, said knife section having a flat leading side and a flat trailing side which intersects the leading side at an acute angle to form a cutting edge, (c) means for securing said knife means to the body member with the leading side of the knife section opposite the leading surface of the cavity and the flat side of the mounting member extended transversely of the body member in a plane substantially parallel to a plane extended diametrically of the body member and through said cutting edge, (d) said cutting edge extended axially of the body member at a position outwardly from the peripheral surface thereof a distance substantially equal to the thickness of a piece to be cut from the material, (e) said trailing side of the knife section and one end of the mounting section located within the confines of the arcuate path defined by the cutting edge of rotation of said body member; whereby the material is cut into pieces, each of which has a length substantially equal to the distance between said two parallel planes and a width no greater than the axial length of the cutting edge, (f) a second axially extended piece-receiving cavity in the outer peripheral surface of the body member positioned diametrically opposite said one cavity and having a leading surface, (g) a second knife means including a mounting section having a flat side and an elongated knife section at one end of said mounting section projected outwardly from said flat side, said knife section having a flat leading side and a flat trailing side which intersects the leading side at an acute angle to form a cutting edge, (h) means for securing said second knife means to the body member with the leading side of the knife section thereof opposite the leading surface of the second cavity, the flat side of the mounting section thereof extended transversely of the body member in a plane substantially parallel to said diametrically extended plane, and the cutting edge thereof positioned in said diametrically extended plane, (i) said cutting edge of the second knife means extended axially of the body member at a position outwardly from the peripheral surface thereof a distance substantially equal to the thickness of the piece to be cut from said material by the first knife means, and (j) said trailing side of the knife section and the one end of the mounting portion of the second knife means located within the confines of the arcuate path defined by the path of the cutting edge of said second knife means on rotation of said body member, whereby the material is cut into pieces having a length substantially equal to the distance between said diametrically extended plane and the flat side of the mounting portion of the second knife means and a width no greater than the axial length of the cutting edge of said second knife means, (k) with the cutting edge of each of said knife means notched so that the notches on one cutting edge are positioned out of a trailing relation with the notches on the other cutting edge whereby the cut pieces are of a strip form.

3. The cutter head according to claim 1 or 2 wherein:

(a) the leading side of the knife section of each said one knife means and second knife means terminates in a groove extended axially of said member and formed in the flat side of the mounting section of each said knife means for breaking each strip piece initially cut from the material into shorter strip pieces of a predetermined length.

* * * * *